United States Patent [19]

Van Poucke et al.

[11] 3,966,475

[45] June 29, 1976

[54] PHOTOGRAPHIC SILVER HALIDE EMULSIONS CONTAINING ACYLACETANILIDE COLOR COUPLERS

[75] Inventors: Raphael Karel Van Poucke, Berchem; Freddy Carolus Baeyens, Wommelgem, both of Belgium

[73] Assignee: AGFA-GEVAERT N.V., Mortsel, Belgium

[22] Filed: Mar. 18, 1974

[21] Appl. No.: 452,327

[30] Foreign Application Priority Data

Apr. 6, 1973 United Kingdom ..... 16625/73

[52] U.S. Cl. ..... 96/55; 96/56.6; 96/100

[51] Int. Cl.[2] ..... G03C 7/00

[58] Field of Search ..... 96/100, 55, 56.6

[56] References Cited

UNITED STATES PATENTS

| | | | |
|---|---|---|---|
| 2,289,805 | 7/1942 | Porter et al. | 96/100 |
| 3,681,076 | 8/1972 | Skoog | 96/100 |
| 3,843,366 | 10/1974 | Van Poucke et al. | 96/100 |

*Primary Examiner*—J. Travis Brown
*Attorney, Agent, or Firm*—A. W. Breiner

[57] ABSTRACT

Novel yellow forming color couplers for use in silver halide color photography are described which correspond to the formula:

$$R—COCHXCONH—Ar—SO_2OY$$

wherein R represents alkyl or phenyl, X represents hydrogen or a displaceable group; Ar represents phenylene and Y represents a carbocyclic aryl group.

6 Claims, No Drawings

PHOTOGRAPHIC SILVER HALIDE EMULSIONS CONTAINING ACYLACETANILIDE COLOR COUPLERS

This invention relates to the production of photographic colour images, to colour couplers for yellow used therein and to photographic materials containing such colour couplers.

It is known that for the production of a photographic colour image in a light-sensitive silver halide layer, the exposed silver halide is developed to a silver image by means of an aromatic primary amino compound in the presence of a colour coupler which reacts with the oxidized developing substance to form a dyestuff on the areas corresponding to the silver image.

In the subtractive three-colour photography a light-sensitive photographic colour material is used containing a red-sensitized, a green-sensitized and a blue-sensitive silver halide emulsion layer wherein on colour development, by use of appropriate colour couplers, a cyan, magenta and yellow dyestuff image are formed respectively.

The colour couplers may be of the diffusible type or of the non-diffusible type. By diffusible couplers is meant colour couplers the dispersability or solubility of which is sufficient to enable them to be usefully incorporated in aqueous colour developing solutions whereas by non-diffusible colour couplers is meant colour couplers intended for use in the photographic element where they should remain during development. Non-diffusible colour couplers are usually obtained by providing in the colour coupler molecule one or more ballasting groups which are sufficiently large to prevent diffusion of the colour coupler e.g. aliphatic groups of 5 to 20 C-atoms.

It is known that for homogeneously distributing non-diffusible colour couplers in a hydrophilic colloid layer, more particularly a silver halide emulsion layer, special techniques are to be used. Colour couplers containing a water-solubilizing group, e.g. a sulpho group can be incorporated in the hydrophilic colloid compositions from alkaline solutions if necessary in the presence of a water-miscible solvent e.g. ethanol. Water-insoluble or sparingly water-soluble color couplers can be incorporated in hydrophilic colloid compositions by dispersing techniques using high-boiling water-immiscible solvents e.g. tricresyl phosphate and dibutylphthalate and/or low boiling water-immiscible solvents e.g. methylene chloride, ethyl acetate, diethyl carbonate, etc.

Therefore, colour couplers should not only have good coupling activity and produce dye images that have the desired spectral absorption characteristics, they also should lend themselves for being homogeneously distributed in the hydrophilic colloid layer and have high stability against crystallization so that colour image formation is not impaired.

In accordance with the present invention novel acylacetanilide colour couplers for yellow are provided which yield upon colour development azomethine dyes having favourable spectral and sensitometric properties. Moreover, the non-diffusible types of these colour couplers lend themselves very well for being incorporated in hydrophilic colloid compositions more particularly a light-sensitive silver halide emulsion by means of dispersion techniques and stable, finely divided dispersions of the colour couplers in the emulsion layers can be obtained in this way.

The acylacetanilide colour couplers according to the present invention are characterized in that the phenyl nucleus of the anilide group carries an aryloxysulphonyl group including a substituted aryloxysulphonyl group. The aryloxysulphonyl group has high stability against hydrolysis contrary to alkoxysulphonyl groups which as is known from British Patent 843,940 are hydrolytically unstable.

More particularly, the acylacetanilide colour couplers according to the present invention can be represented by the following general formula:

$$R—COCHXCONH—Ar—SO_2OY$$

wherein:

R represents alkyl, phenyl including substituted phenyl e.g. phenyl substituted with halogen, alkoxy e.g. methoxy and hexadecyloxy, substituted alkoxy e.g. halogen substituted alkoxy, acylamino and aminosulphonyl, Ar represents phenylene including substituted phenylene e.g. phenylene substituted with halogen and alkoxy, X represents a hydrogen atom or a substituent that exhibits two equivalent character on colour development, e.g. a halogen atom e.g. chlorine, a -S-R′ group wherein R′ is alkyl, substituted alkyl, aryl, substituted aryl, a heterocycle or a substituted heterocycle, or a —O—R″ group wherein R″ represents alkyl, substituted alkyl, aryl, substituted aryl, acyl or substituted acyl e.g. acetyl and benzoyl, and Y represents a carbocyclic aryl group e.g. phenyl which may be substituted e.g. with one or more of the groups alkyl, cycloalkyl, hydroxy, halogen, alkoxy, alkylthio or alkylsulphonyl.

The term "two-equivalent character" as applied to colour coupling systems is well known, and is described for example in "The Theory of the Photographic Process", C. E. K. Mees, the Mac Millan Company, New York, 1966, page 390. It means that by the presence of the splittable substituent on the active methylene group only two equivalents of silver ion are needed for the formation of the dye contrary to four equivalents when the methylene group is not substituted.

The colour couplers for yellow according to the present invention can be of the diffusible or non-diffusible type as described above. The invention is particularly concerned with non-diffusible colour couplers for use in the photographic element itself. For this purpose the colour couplers can be provided in the acyl and/or anilide part of the molecule with one or more ballasting groups having an aliphatic straight-chain or branched-chain hydrocarbon group of at least 5C-atoms.

The preferred colour couplers of the present invention are non-diffusible benzoylacetanilide colour couplers comprising in both the benzoyl and anilide nucleus an alkoxy-substituent preferably ortho-alkoxy substituents.

The present invention provides besides novel acylacetanilide compounds, a method of producing a yellow coloured photographic image in a photographic light-sensitive silver halide material which comprises exposing the material and developing it with an aromatic primary amino colour developing agent in the presence of an acylacetanilide colour coupler as defined above.

The present invention further provides a photographic element containing at least one silver halide emulsion layer and an acylacetanilide colour coupler as defined above comprising in its molecule one or more aliphatic hydrocarbon groups of at least 5C-atoms.

The colour couplers of the present invention can be prepared according to methods known in the art. For example, they can be prepared by reaction of known acylacetic acid esters e.g. benzoylacetic acid esters with an aryloxysulphonyl aniline.

The aryloxysulphonylanilines can be prepared by means of one of the following procedures:

1. reaction of a nitrobenzene sulphochloride with a phenol or naphthol in pyridine followed by catalytic hydrogenation;

2. reaction of an acetylaminobenzene sulphochloride with a phenol or naphthol in pyridine followed by deacetylation, and
3. reaction of a nitrobenzene sulphochloride with the sodium salt of a phenol or naphthol in benzene followed by catalytic hydrogenation.

Representative aryloxysulphonylanilines prepared according to one of the above procedures and useful for the preparation of the colour couplers of the invention are listed in the following Table I.

Table I

| | Amine compound | Procedure | Melting point °C |
|---|---|---|---|
| 1. | 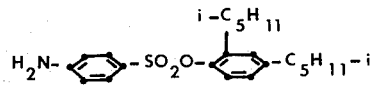 | 1 | 106 |
| 2. | 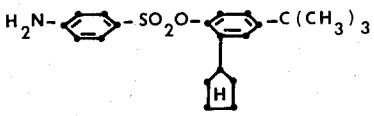 | 1 | 119 |
| 3. | 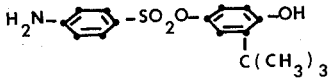 | 1 | 165 |
| 4. | 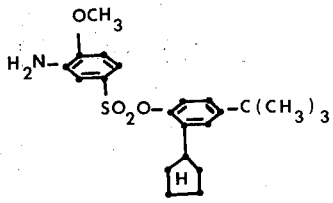 | 2 | 103 |
| 5. | 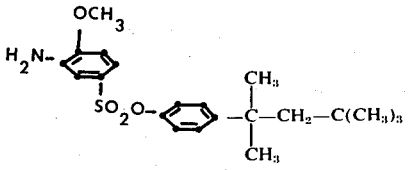 | 2 | 98 |
| 6. | 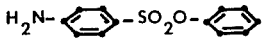 | 1 | 146 |
| 7. | 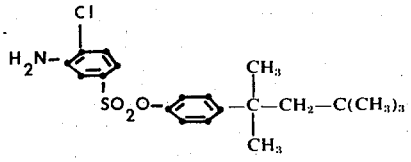 | 3 | 105 |
| 8. | 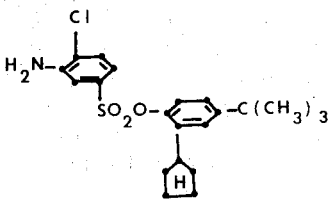 | 3 | 101 |

Table I-continued

| | Amine compound | Procedure | Melting point °C |
|---|---|---|---|
| 9. | 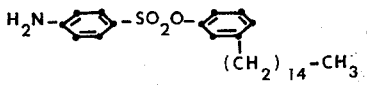 | 1 | 73 |
| 10. | 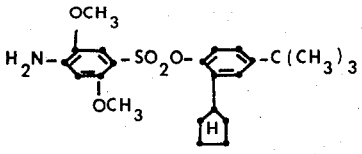 | 1 | 113 |
| 11. | 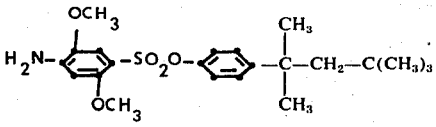 | 1 | 146 |
| 12. | 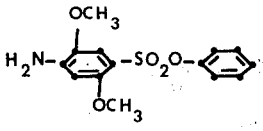 | 1 | 138 |
| 13. | 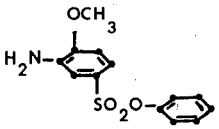 | 2 | 63 |
| 14. | 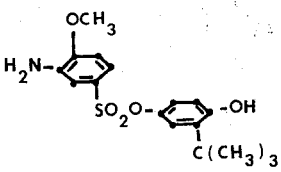 | 2 | 135 |

The following preparation illustrates how the colour couplers of the invention can be prepared. Representative examples of colour couplers prepared according to this procedure are listed in table II hereinafter.

Preparation: colour coupler 1 of table II hereinafter was prepared as follows:

52.25 g of o-hexadecyloxybenzoylacetic acid methyl ester and 34.85 g of 2-methoxy-5-phenyloxysulphonylaniline were boiled in 90 ml of xylene while removing the alcohol formed by distillation. Boiling was continued for 3 hours whereupon the xylene was removed by distillation under reduced pressure. The residue was dissolved in methanol with heating. The precipitate formed while stirring was filtered off and recrystallized from methanol-diisopropylether (1:1).

Yield: 67%. Melting point: 65°C.

Table II
| | Colour Coupler | Melting point | Yield % | recrystallization solvent |
|---|---|---|---|---|
| 1. | 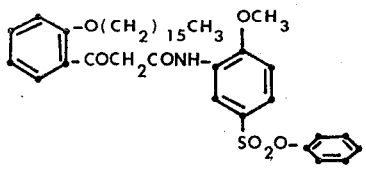 | 65 | 67 | methanol/diisopropylether (1:1) |
| 2. | 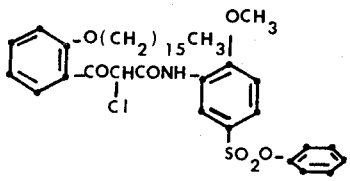 | 66 | 93 | isopropanol |
| 3. | 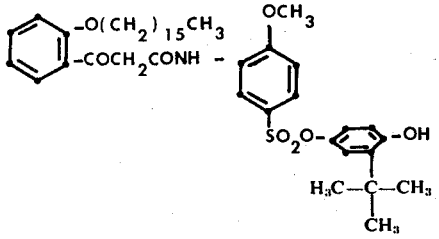 | 70 | 85 | benzene-hexane (1:2) |
| 4. | 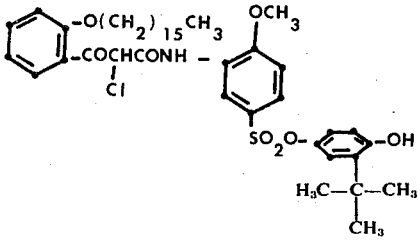 | oil | 94.5 | — |
| 5. | 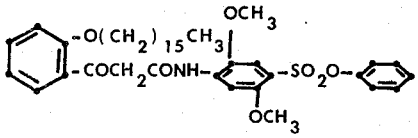 | 80 | 64 | acetonitrile |
| 6. | 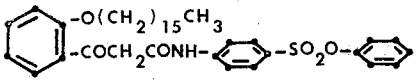 | 68 | 66 | isopropanol |
| 7. | 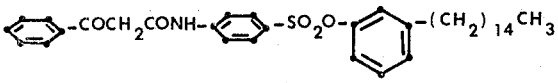 | 94 | 80 | xylene |

Table II-continued
| Colour Coupler | Melting point | Yield % | recrystallization solvent |
|---|---|---|---|
| 8. 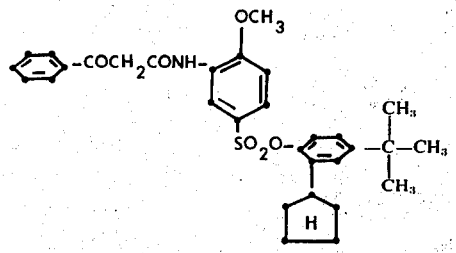 | 114–117 | 84.5 | ethanol |
| 9. 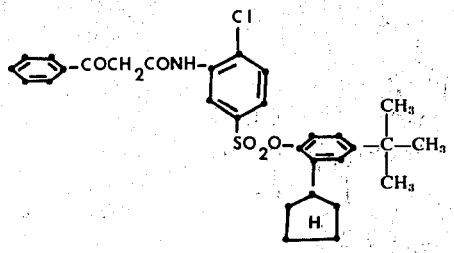 | 121 | 68 | ethanol |
| 10. 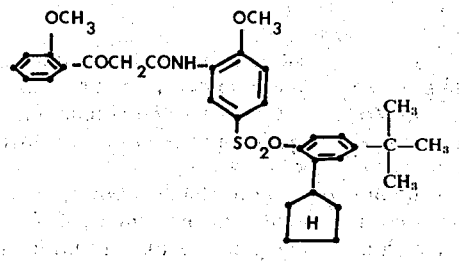 | 106 | 70 | isopropanol |
| 11. 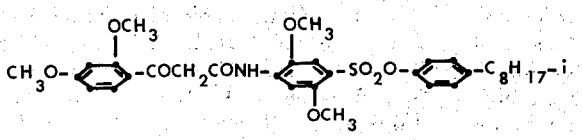 | 133 | 90 | methanol |
| 12. 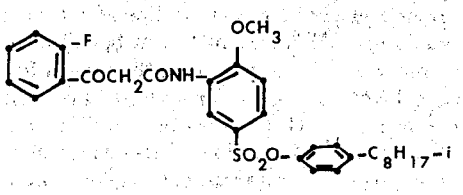 | 103 | 55 | isopropanol |

Table II-continued

| | Colour Coupler | Melting point | Yield % | recrystallization solvent |
|---|---|---|---|---|
| 13. | 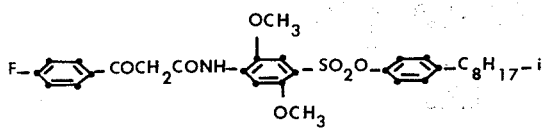 | 127–129 | 64 | isopropanol |
| 14. | 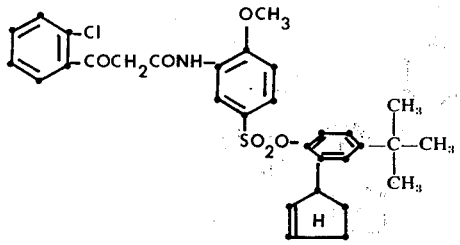 | 128 | 83.5 | isopropanol |
| 15. | 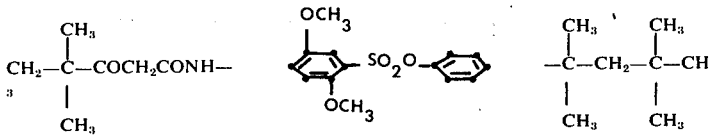 | 161–163 | 68.5 | ethylene glycol monomethyl ether |

The non-diffusible colour couplers according to the present invention can be incorporated into the photographic silver halide element according to any suitable technique known in the art. The colour couplers of the invention are preferably incorporated into photographic hydrophilic colloid media from solutions in high boiling sparingly water-miscible solvents such as di-n-butyl phthalate and tricresyl phosphate or in low-boiling sparingly water-miscible solvents such as ethyl acetate, methylene chloride, diethyl carbonate, chloroform, etc. or mixtures thereof in that they have a high solubility therein and very fine dispersions can be obtained by means of these solvents.

For this purpose these solutions can be dispersed in extremely fine droplets, preferably in the presence of one or more wetting or dispersing agents into a hydrophilic colloid medium e.g. aqueous gelatin or into water, the low-boiling sparingly water-miscible solvent then being removed by evaporation. The stable dispersions of the colour couplers can be stored as such and then admixed whenever desired with coating composition itself of the hydrophilic colloid layer such as a silver halide emulsion layer into which the compounds are intended to be present.

Of course the compounds of the invention can also be incorporated into the hydrophilic colloid media in other ways.

More details about particularly suitable techniques that may be employed for incorporating the colour couplers of the invention into a hydrophilic colloid layer or a photographic material there can be referred to e.g. U.S. Pat. Nos. 2,269,158; 2,284,887; 2,304,939; 2,304,940 and 2,322,027, United Kingdom Patent Specifications 791,219; 1,098,594; 1,099,414; 1,099,415; 1,099,416; 1,099,417; 1,218,190; 1,272,561 and 1,297,347, French Patent Specification 1,555,663, Belgian Patent Specification 722,026, German Patent Specification 1,127,714 and to United Kingdom Patent Specification 1,297,947.

Aqueous of the non-diffusible colour couplers of the present invention have better stability than aqueous dispersions of non-diffusible prior art colour couplers for yellow. This can be illustrated as follows.

Aqueous dispersions of colour coupler 2 of the above table II corresponding to the formula:

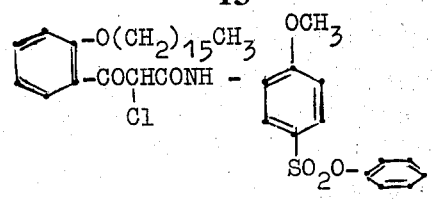

and of the prior art colour coupler (of British Patent Application 11,340/72) corresponding to the formula:

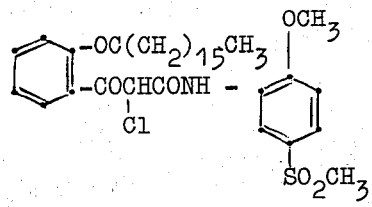

were prepared according to the technique described in British Patent Specification 1,297,947. For this purpose, 10 g of colour coupler were dissolved in 30 ml of ethyl acetate and the solution dispersed in 100 ml of water comprising 2 ml of ethyl acetate and 12.50 ml of a 10% aqueous solution of the sodium salt of N-oleylmethyl tauride as dispersing agent. The ethyl acetate was then removed by evaporation under reduced pressure to leave an aqueous dispersion of colour coupler.

The dispersions of both colour couplers were left standing for 1 month at room temperature and then examined microscopically by phase contrast. In the dispersion of the colour coupler of the invention no particles larger than 0.5 $\mu$m could be observed whereas in the dispersion of the prior art colour coupler, the colour coupler particles have dimensions of 2 $\mu$m.

The couplers according to the invention may be used in conjunction with various kinds of photographic emulsions. Various silver salts may be used as the sensitive salt such as silver bromide, silver iodide, silver chloride or mixed silver halides such as silver chlorobromide, silver bromoiodide and silver chlorobromoiodide. The couplers can be used in emulsions of the mixed packet type as described in U.S. Pat. No. 2,698,794 or emulsions of the mixed grain type as described in U.S. Pat. No. 2,592,243. The colour couplers can be used with emulsions wherein latent images are formed predominantly on the surface of the silver halide crystal, or with emulsions wherein latent images are formed predominantly inside the silver halide crystal.

The hydrophilic colloid used as the vehicle for the silver halide may be, for example, gelatin, colloidal albumin, zein, casein, a cellulose derivative, a synthetic hydrophilic colloid such as polyvinyl alcohol, poly-N-vinyl pyrrolidone, etc. If desired, compatible mixtures of two or more of these colloids may be employed for dispersing the silver halide.

The light-sensitive silver halide emulsions of use in the preparation of a photographic material according to the present invention may be chemically as well as optically sensitized. They may be chemically sensitized by effecting the ripening in the presence of small amounts of sulphur containing compounds such as allyl thiocyanate, allyl thiourea, sodium thiosulphate, etc. The emulsions may also be sensitized by means of reductors for instance tin compounds as described in French Patent Specification 1,146,955 and in Belgian Patent Specification 568,687, imino-amino methane sulphinic acid compounds as described in United Kingdom Patent Specification 789,823 and small amounts of noble metal compounds such as gold, platinum, palladium, iridium, ruthenium and rhodium compounds. They may be optically sensitized by means of cyanine and merocyanine dyes.

The said emulsions may also comprise compounds which sensitize the emulsions by development acceleration for example compounds of the polyoxyalkylene type such as alkylene oxide condensation products as described among others in U.S. Pat. No. 2,531,832; 2,533,990; 3,210,191 and 3,158,484, in United Kingdom Patent Specifications 920,637 and 991,608 and in Belgian Patent Specification 648,710 and onium derivatives of amino-N-oxides as described in United Kingdom Patent Specification 1,121,696.

Further, the emulsions may comprise stabilizers e.g. heterocyclic nitrogen-containing thioxo compounds such as benzothiazoline-2-thione and 1-(phenyl-2-tetrazoline-5-thione and compounds of the hydroxytriazolopyrimidine type. They can also be stabilized with mercury compounds such as the mercury compounds described in Belgian Patent Specifications 524,121 - 677,337 and 707,386 and in U.S. Pat. No. 3,179,520.

The light-sensitive emulsions may also comprise all other kinds of ingredients such as plasticizers, hardening agents, wetting agents, etc.

The non-diffusing magenta colour formers described in the present invention are usually incorporated into the green-sensitized silver halide emulsion for forming one of the differently sensitized silver halide emulsion layers of a photographic multilayer colour material. Such photographic multilayer colour material usually comprises a support, a red-sensitized silver halide emulsion layer with a cyan colour former, a green-sensitized silver halide emulsion layer with a magenta colour former and a blue-sensitive silver halide emulsion layer with a yellow colour former.

The emulsions can be coated on a wide variety of photographic emulsion supports. Typical supports include cellulose ester film, polyvinylacetal film, polystyrene film, polyethylene terephthalate film and related films or resinous materials, as well as paper and glass. It is also possible to employ paper coated with $\alpha$-olefin polymers e.g. paper coated with polyethylene, polypropylene, ethylene-butylene copolymers, etc.

For the production of photographic colour images according to the present invention an exposed silver halide emulsion layer is developed with an aromatic primary amino developing substance in the presence of a colour coupler according to the present invention. All colour developing agents capable of forming azomethine dyes can be utilised as developers. Suitable developing agents are aromatic compounds such as p-phenylene diamine and derivatives for example N,N-diethyl-p-phenylene diamine, N-butyl-N-sulphobutyl-p-phenylene diamine, N,N-diethyl-N'-sulphomethyl-p-phenylene diamine, N,N-diethyl-N'-carboxymethyl-p-phenylene diamine, 2-amino-5-diethylaminotoluene, 4-amino-N-ethyl-N($\beta$-methanesulphonamidoethyl)-m-toluidine, N-hydroxyethyl-N-ethyl-p-phenylene diamine, etc.

The following examples illustrate the present invention.

EXAMPLE 1

117 g of a blue-sensitive bromo-iodide emulsion (2.3 mole % of iodide) containing per kg 73.4 g of gelatin and an amount of silver halide equivalent to 47 g of silver nitrate were melted and diluted with 192.5 g of a 7.5% aqueous solution of gelatin and 100 g of distilled water. To the emulsion obtained was added a gelatin gel comprising a dispersion of colour coupler 5. This gel was prepared by admixing by means of an ultrasonic wave generator a solution of 0.006 mole of said colour coupler in 14 ml of ethyl acetate with 100 ml of a 5% solution of gelatin containing a solution of 0.5 g of the sodium salt of lauryl benzene sulphonate, and then removing the ethyl acetate by evaporation.

After addition of the usual additives such as hardeners, wetting agents and stabilizer the necessary amount of distilled water to obtain 575 g of emulsion was added whereupon the emulsion was coated on a cellulose triacetate support pro rata 150 g per sq.m. The emulsion layer was dried and overcoated with a gelatin antistress layer.

After drying, the material formed was exposed for 1/20 sec. through a continuous wedge with constant 0.30 and then developed for 8 min. at 20°C in a developing bath of the following composition:

| | |
|---|---|
| N,N-diethyl-p-phenylene diamine sulphate | 2.75 g |
| hydroxylamine sulphate | 1.2 g |
| sodium hexametaphosphate | 4 g |
| anhydrous sodium sulphite | 2 g |
| anhydrous potassium carbonate | 75 g |
| potassium bromide | 2.5 g |
| water to make | 1 liter |

The developed materials were treated for 2 min. at 18°–20°C in an intermediate bath comprising 30 g of sodium sulphate in 1 liter of water.

The materials were rinsed for 15 min. with water and treated in a bleach bath of the following composition:

| | |
|---|---|
| borax | 20 g |
| anhydrous potassium bromide | 15 g |
| anhydrous sodium bisulphate | 4.2 g |
| potassium hexacyanoferrate(III) | 100 g |
| water to make | 1 liter |

After bleaching, the materials were rinsed with water for 5 min. and fixed in an aqueous solution of 200 g of sodium thiosulphate per liter.

After a final rinsing for 15 min. the materials were dried.

A yellow coloured wedge image was obtained having absorption maximum at 440 nm.

EXAMPLE 2

0.006 mole of colour coupler 2 was dissolved in 14 ml of ethyl acetate. This solution was mixed with 106 ml of 10% aqueous gelatin solution containing 5 ml of a 10% aqueous solution of the sodium salt of benzyl benzene sulphonate. Homogenization of the mixture was effected by means of an ultrasonic wave generator.

After evaporation of the ethyl acetate the dispersion was mixed with 117 g of a blue-sensitive bromo-iodide emulsion as described in example 1.

The emulsion was coated and exposed as described in example 1 whereupon it was developed in the following composition:

| | |
|---|---|
| 2-amino-5-diethylamino toluene HCL | 2 g |
| anhydrous sodium sulphite | 2 g |
| anhydrous sodium carbonate | 20 g |
| potassium bromide | 1 g |
| water to make | 1 liter |

After bleaching and fixing in the conventional way to remove the silver image and unexposed silver halide, a yellow wedge image was obtained having absorption maximum at 444 nm with little sideabsorption in the green region of the spectrum.

We claim:

1. Method of producing a yellow colored photographic image in a photographic light-sensitive silver halide material comprising exposing a photographic light-sensitive silver halide material and developing it with an aromatic primary amino color developing agent in the presence of a benzoylacetanilide color coupler having the formula:

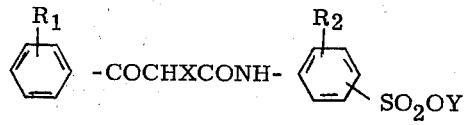

wherein $R_1$ represents an alkoxy group, $R_2$ represents alkoxy,

X represents hydrogen, halogen, a —S—R′ group wherein R′ is an alkyl group, an aryl group or a heterocyclic group, a —O—R″ group wherein R″ represents an alkyl group or an aryl group, or an acyl group, and Y represents a carbocyclic aryl group.

2. The method of claim 1 wherein $R_1$ and $R_2$ are in the ortho-position with respect to the acetanilide moiety.

3. Method according to claim 2 wherein in the formula of the acylacetanilide compound Y represents a phenyl group or a phenyl group substituted with one or more alkyl, cycloalkyl, hydroxy, halogen, alkoxy, alkylthio or alkylsulphonyl groups.

4. A photographic element comprising at least one silver halide emulsion layer and a benzoylacetanilide color coupler corresponding to the formula:

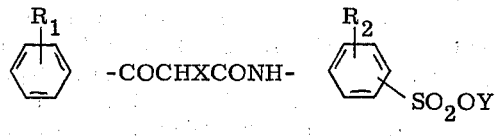

wherein $R_1$ represents an alkoxy group, $R_2$ represents alkoxy,

X represents hydrogen, halogen, a —S—R′ group wherein R′is an alkyl group, an aryl group or a heterocyclic group, a —O—R″ group wherein R″ represents an alkyl group or an aryl group, or an acyl group, and Y represents a carbocyclic aryl group.

5. The photographic element of claim 4 wherein $R_1$ and $R_2$ are in the ortho-position with respect to the acetanilide moiety.

6. A photographic element according to claim 5 wherein, in the formula of the colour coupler Y represents a phenyl group or a phenyl group substituted with one or more alkyl, cycloalkyl, hydroxy, halogen, alkoxy, alkylthio or alkyl sulphonyl groups.

* * * * *